United States Patent [19]

Hart et al.

[11] Patent Number: 4,905,820

[45] Date of Patent: Mar. 6, 1990

[54] DISPLAY CARTON

[75] Inventors: Joseph J. Hart, Philadelphia; Angela L. Rowland, Trappe, both of Pa.

[73] Assignee: Container Corporation of America, Clayton, Mo.

[21] Appl. No.: 392,005

[22] Filed: Aug. 3, 1989

[51] Int. Cl.[4] ..... B65D 5/50

[52] U.S. Cl. ..... 206/45.14; 206/45.31; 206/491

[58] Field of Search ..... 206/45.14, 45.31, 277, 206/491, 583; 229/16 D

[56] References Cited

U.S. PATENT DOCUMENTS

| | | | |
|---|---|---|---|
| 3,036,754 | 5/1962 | Kleingers, Jr. | 206/45.31 |
| 3,292,777 | 12/1966 | Desmond | 206/45.14 |
| 3,360,117 | 12/1967 | Powers et al. | 206/45.14 |
| 3,489,269 | 1/1970 | Rosenburg, Jr. | 206/45.14 |
| 3,543,919 | 12/1970 | Lewis | 206/45.14 |
| 3,592,338 | 12/1971 | Hason | 206/45.19 |
| 3,741,380 | 6/1973 | Carney | 206/45.14 |
| 3,747,831 | 7/1973 | Hanson | 206/45.14 |
| 4,117,924 | 10/1978 | Growney | 206/45.31 |
| 4,159,765 | 7/1979 | Roccaforte | 206/45.31 |
| 4,264,006 | 4/1981 | Swanberg | 206/45.19 |
| 4,836,364 | 6/1989 | Hanko et al. | 206/45.31 |

*Primary Examiner*—David T. Fidei

*Attorney, Agent, or Firm*—Richard W. Carpenter

[57] ABSTRACT

A display carton formed from a one-piece paperboard blank and having a front wall that includes a pair of inner and outer panel sections each with a pair of inclined shadow panels that form a well for holding and supporting a packaged article. The inner shadow panels are spaced from each other and have aligned openings for receiving portions of the article, and the outer shadow panels are interconnected by a cradle member for holding another portion of the article.

9 Claims, 2 Drawing Sheets

DISPLAY CARTON

BACKGROUND OF THE INVENTION

1. Field of the Invention:

This invention relates to display cartons, and more particularly to a paperboard display carton having a recessed portion or well receiving opposed pairs of shadow panels adapted to hold a packaged article for display.

2. Description of Background Art:

A background art search directed to the subject matter of this application conducted in the United States Patent and Trademark Office disclosed the following U.S. Letters Pat. Nos.: Re.28,530, 3,292,777, 3,360,177, 3,489,269, 3,543,919, 3,592,338, 3,741,380, 3,747,831, 4,109,924, 4,117,924.

None of the patents uncovered in the search discloses a display carton formed of one-piece paperboard blank and having a front wall that includes inner and outer panel sections, each with a pair of inclined shadow panels that form a well for holding and supporting a packaged article, and wherein the shadow panels of one pair are spaced from each other and have aligned openings adapted to receive portions of the article and the shadow panels of the other pair are interconnected by a cradle member adapted to hold another portion of the article.

SUMMARY OF THE INVENTION

It is a primary object of the present invention to provide a display carton formed from a one-piece blank of foldable paperboard for holding and displaying an elongated packaged article, such as a bottle or tube.

A more specific object of the invention is to provide a shadow box type display carton with a front wall that includes inner and outer sections having cooperating sets of shadow panels adapted to hold and retain a packaged article for display.

These and other objects of the invention will be apparent from an examination of the following description and drawings.

It will be understood that, for purposes of clarity, certain elements may have been intentionally omitted from certain views where they illustrated to better advantage in other views.

DESCRIPTION OF THE PREFERRED EMBODIMENT

Figure 1:
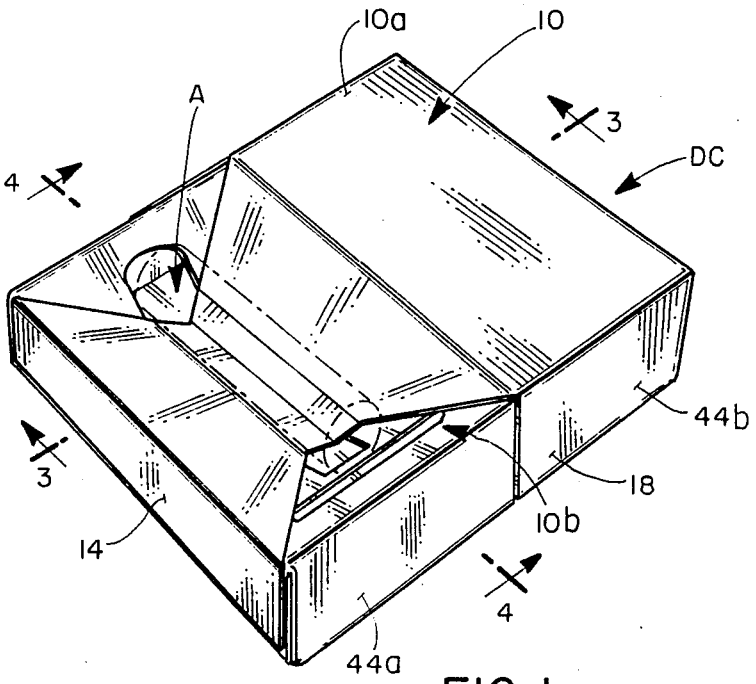
FIG. 1 is a fragmentary isometric view of a display carton embodying features of the present invention.
Figure 2:
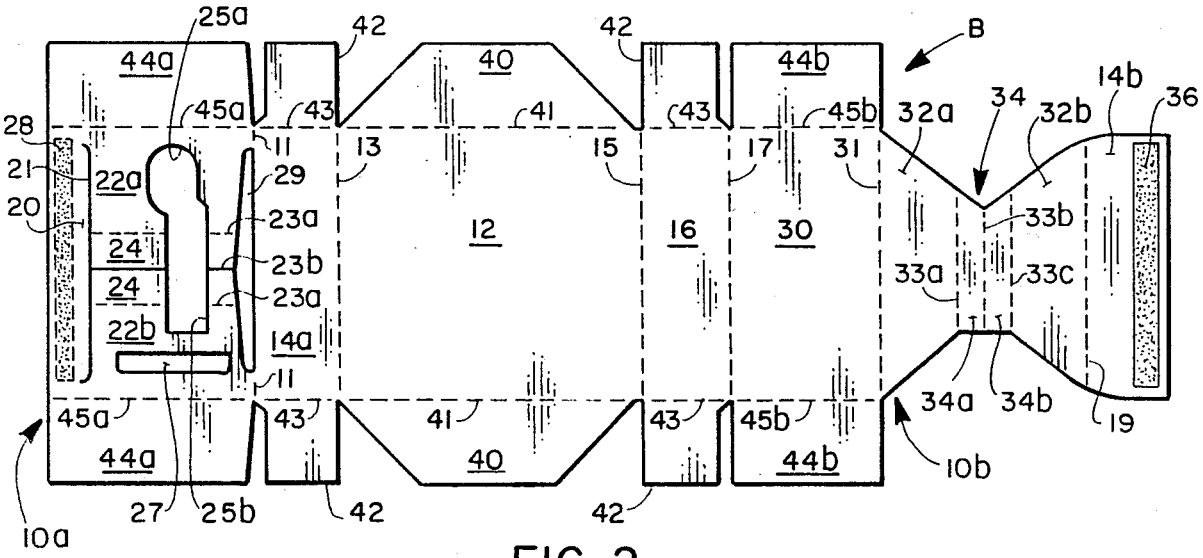
FIG. 2 is a plan view of a blank of foldable sheet material from which the display carton illustrated in the other views may be formed.

Referring now to the drawings for better understanding of the invention, it will be seen that the unique display carton, indicated generally at DC in FIG. 1, may be formed from the unitary blank B of foldable sheet material, such as paperboard, illustrated in FIG. 2 of the drawings.

Figure 3:
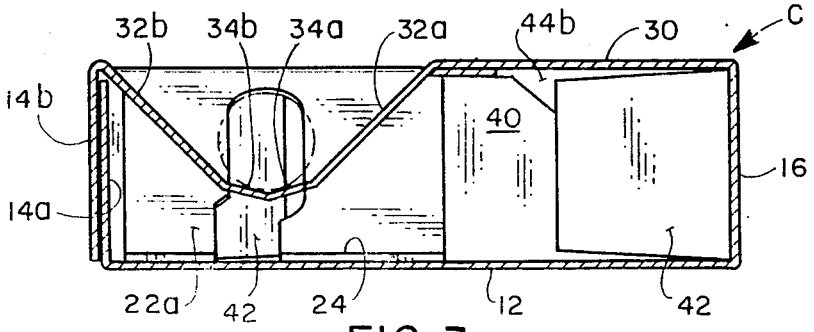
FIGS. 3 and 4 are vertical sectional views taken on lines 3—3 and 4—4, respectively, of FIG. 1.
Figure 4:
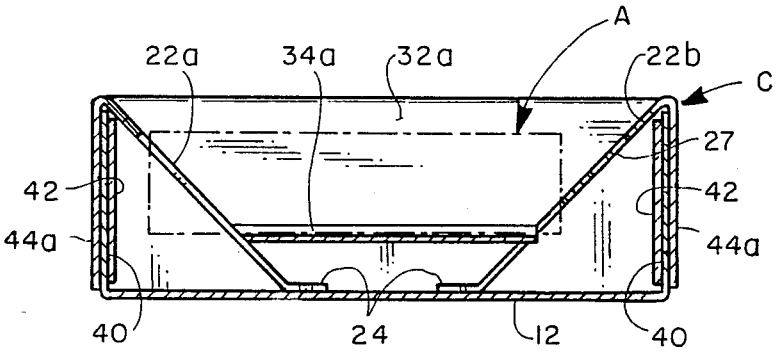

As best seen in FIGS. 1, 3, and 4, carton C includes a front main wall 10 and a rear main wall 12 that are interconnected by a pair of first and second side walls 14 and 16, respectively, and a pair of end wall 18, to form a box-like structure. Front main wall 10 includes a pair of inner and outer sections **10*a* and 10*b***, respectively, which have overlapping portions secured to each other.

As best seen in FIG. 2, the central portion or body of the carton includes front main wall inner section **10*a*, first side wall inner panel 14*a*, rear main wall panel 12, second side wall panel 16, front main wall outer section 10*b*, and first side wall outer panel or glue flap 14*b*, which are foldably joined to each other along parallel fold lines 11, 13, 15, 17, and 19**, respectively.

Still referring to FIG. 2 of the drawings, it will be seen that front main wall inner section **10*a* includes a pair of first and second end shadow panels 22*a* and 22*b*, respectively, which extend inboardly toward each other and rearwardly toward rear main wall panel 12**.

End shadow panels **22*a* and 22*b* have outboard corner portions that are foldably joined along spaced fold lines 11 to adjacent first side wall inner panel 14*a*. Intermediate fold lines 11, the shadow panels are separated from the adjacent first side wall inner panel 14*a* by an elongated opening 29**.

At the opposite side of the front wall inner sections, remote from first side wall panel **14*a*, is a relatively narrow, elongated side panel or glue panel 20, which is separated from the shadow panels 22*a* and 22*b* by a cut line 21**.

The front wall inner section also includes a pair of anchor panels 24 which are foldably joined to the inboard edges of first and second end shadow panels **22*a* and 22*b* along parallel fold lines 23*a* and 23*b***, respectively.

The shadow panels **22*a* and 22*b*, as well as their related anchor panels 24, are provided with communicating openings 25*a* and 25*b*, respectively, which form a common opening for receiving portions of a packaged article as hereinafter described. Panel 22*b* may also be provided with an additional opening 27** which is adapted to receive another portion of the packaged article.

It will be seen that front wall inner section side panel 20 is provided with a glue pattern 28 in order to secure it to the front wall outer section in a manner hereinafter described.

Still referring to FIG. 2 of the drawings, it will be seen that front wall outer section **10*b* includes a cover panel 30, which has a width approximately one-half the width of rear main wall panel 12, and which is foldably joined to second side wall panel 16 along a fold line 17**.

The front wall outer section also includes a pair of first and second side shadow panels **32*a* and 32*b*, respectively, which have adjacent side edges interconnected by a cradle member 34**.

First side shadow panel **32*a* is foldably joined to cover panel 30 along fold line 31, and second side shadow panel 32*b* is foldably joined to first side wall outer panel or glue flap 14*b* along a fold line 19**.

Cradle member 34 includes a pair of first and second elements **34*a* and 34*b* that are foldably joined to side shadow panels 32*a* and 32*b* along fold lines 33*a* and 33*c*, respectively, and which are foldably joined to each other along fold line 33*b***.

It will be seen that an adhesive pattern 36 is applied to first side wall outer panel or glue flap **14*b* in order to secure it to the outer surface of first side wall inner panel 14*a*, as shown in FIG. 3, in order to form a tubular structure open at the ends. At the same time the glue pattern 28 serves to secure front wall inner section side panel 20 to the undersurface of front wall outer section cover panel 30** to complete the formation of the tubular structure.

Each of the end walls of the carton include an inner panel 40, foldably joined to an end edge of rear wall panel 12 along fold line 41, a pair of intermediate panels 42, foldably joined to end edges of side wall panels **14*a* and 16, along fold lines 43, and a pair of first and second outer panel sections 44*a* and 44*b*, foldably joined to end edges of front wall inner section end shadow panel and to the outer section cover panel along fold lines 45*a* and 45*b***, respectively.

Figure 5:
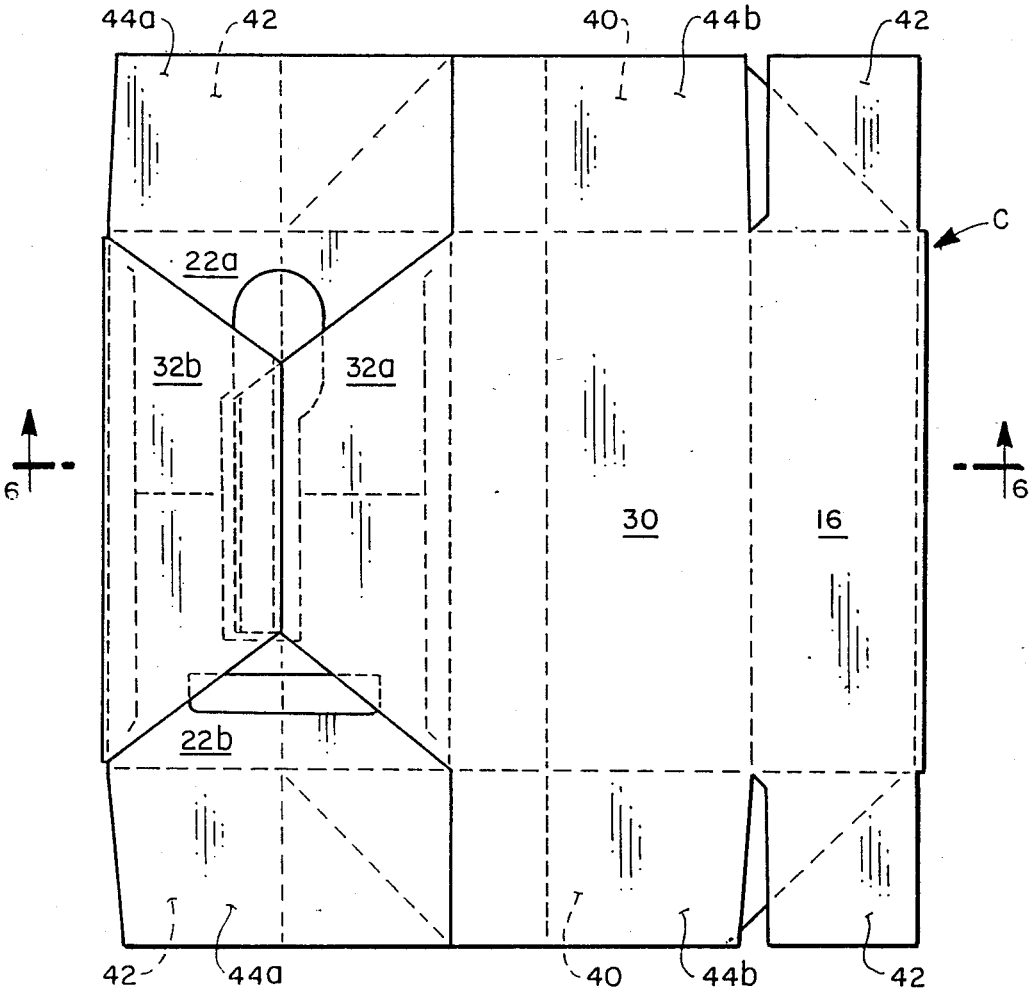
FIG. 5 is a plan view of the carton illustrated in FIG. 1, but shown in a collapsed condition.
Figure 6:
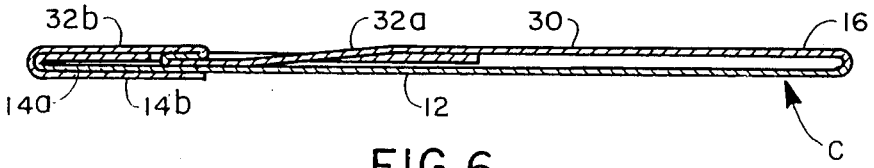
FIG. 6 is a vertical sectional view taken on line 6—6 of FIG. 5.

Referring now to FIGS. 5 and 6, it will be seen that carton C is formed from the blank B by folding the front wall outer section 180 along fold line 17, so that it overlies the remaining portion of the blank, with first side wall outer panel **14*b* overlying the first side wall inner panel 14*a*. This is possible, because the fold line 33*b* permits the two cradle 32*a* and 32*b*** of the cradle to be folded temporarily into overlapped relationship.

First side wall inner and outer panels are adhesively secured to each other, and and front wall inner section side panel 20 is adhesively secured to front wall outer section cover panel 30 to form a tubular structure.

After the carton body has been formed and erected, the end walls can be formed by folding the end wall flaps into overlapped relation and securing them to each other in a conventional manner.

When the carton is erected, as shown in FIG. 1, the front wall outer section cover panel, which represents about half of the front wall width, is available for advertising copy, while the other half of the front wall presents a well for holding and displaying a packaged article.

As best seen in FIGS. 1, 3, and 4, the end shadow panels of the front wall inner section are disposed to slope inboardly and rearwardly toward the rear wall 12 of the carton, with the anchor panels 24 overlying the near surface of rear wall 12.

Also, the front wall outer section side shadow panels are disposed to slope toward each other and toward the rear wall of the carton, with cradle member 34 serving to interconnect the lower ends of the side shadow panels.

The cradle member is disposed above and parallel to the rear wall of the carton and is adapted to hold a center portion of a packaged article, with the end portions of the packaged article being received in the opening of the front wall inner section end shadow panels.

Thus, the invention provides a novel display carton that can be made from a unitary blank of foldably paperboard, that can be formed into a tubular structure and glued by the manufacturer, and that can be shipped in collapsed flattened condition to the packer, and cab be erected rapidly and filled by the packer.

What is claimed is:

1. A display carton for holding and displaying an elongated article, such as a bottle or tube, said carton being formed from a unitary blank of foldable sheet material, such as paperboard, and comprising:

(a) opposed front and rear main walls and opposed side walls foldably interconnected to form a tubular structure open at the ends;

(b) end walls each including a plurality of end closure flaps foldably joined to said main and side walls and secured to each other in overlapped relation to close said ends;

(c) said front main wall including inner and outer sections;

(d) said inner section including:

(i) a pair of end shadow panels foldably joined to front edges of respective end walls and sloping inboardly and rearwardly toward said rear main wall;

(ii) said end shadow panels presenting cooperating openings adapted to receive and retain portions of a packaged article;

(iii) anchor panels foldably joined to inboard edges of respective end shadow panels and disposed adjacent said rear main wall;

(iv) a relatively narrow glue disposed adjacent said end shadow and anchor panels and separated therefrom by a cut line;

(e) said front main wall outer section including:

(i) a cover panel foldably joined to a front edge of one of said side walls and extending inboardly therefrom to a location intermediate said side walls;

(ii) a pair of side shadow panels foldably joined to an inboard edge of said cover panel and a front edge of the other of said side walls, respectively;

(iii) said side shadow panels sloping inboardly and rearwardly toward said rear main wall;

(iv) a cradle member having opposite side edges foldably joined to adjacent inboard edges of respective side shadow panels and adapted to support another portion of a packaged article.

2. A blank of foldable sheet material, such as paperboard, for use in forming a display carton adapted to hold and display a packaged article, said blank being cut and scored to provide:

(a) a generally rectangular rear main wall panel having opposed side edges and opposed end edges;

(b) a pair of side wall panels having having first side edges foldably joined to to respective side edges of said front main wall panel and also having opposed second side edges and opposed end edges;

(c) front main wall panel inner and outer sections foldably joined to adjacent second side edges of respective side wall panels;

(d) said inner section including a pair of end shadow panels extending toward each other in a direction transversely of said blank and presenting aligned openings adapted to hold and retain portions of a packaged article when said blank is erected into a carton;

(e) said outer section including a cover panel foldably joined to one of said side walls and a pair of side shadows panels foldably joined to said cover panel and extending toward each other in a direction longitudinally of said blank and having inboard edges placed from each other and interconnected by a cradle member adapted to hold another portion of a packaged article when said blank is erected into a carton;

(f) end closure flaps foldably joined to end edges of certain of said main and side wall panels.

3. A display carton for holding and displaying an elongated article, such as a bottle or tube, said carton being formed a unitary blank of foldable sheet material, such as paperboard, and comprising:

(a) oppposed front and rear main walls and opposed side walls foldably interconnected to form a tubular structure open at the ends;

(b) end walls each including a plurality of end closure flaps foldably joined to said main and side walls and secured to a each other in overlapped relation to close said ends;

(c) said front main wall including inner and outer sections;

(d) said inner section including:

(i) a pair of end shadow panels foldably joined to front edges of respective end walls and sloping inboardly and rearwardly toward said rear main wall;

(ii) said end shadow panels presenting cooperating openings adapted to receive and retain portions of a packaged article;

(e) said front main wall outer section including:

(i) a cover panel foldably joined at one side edge to a front edge of one of said side walls and having another side edge;

(ii) a pair of side shadow panels foldably joined to the other side edge of said cover panel and disposed to slope inboardly and rearwardly toward said rear main wall;

(iii) a cradle member having opposite side edges foldably joined to adjacent lower edges of respective side shadow panels and adapted to support another portion of a packaged article.

4. A carton according to claim 3 and including anchor panels foldably joined to inboard edges of respective end shadow panels and disposed adjacent said rear wall.

5. A carton according to claim 1, wherein said anchor panels and related end shadow panels present common openings communicating with each other.

6. A carton according to claim 4, wherein said anchor panels and related end shadow panels present common openings communicating with each other.

7. A carton according to claim 1, wherein said cradle member includes a pair of cradle elements foldably joined to each other and to respective side shadow panels.

8. A carton according to claim 3, wherein said cradle member includes a pair of cradle elements foldably joined to each other and to respective side shadow panels.

9. A blank according to claim 2, wherein said cradle member includes a pair of cradle elements foldably joined to each other and to respective side shadow panels.

* * * * *